US008440909B2

(12) United States Patent
Van Der Meer

(10) Patent No.: US 8,440,909 B2
(45) Date of Patent: May 14, 2013

(54) DATA CABLE WITH FREE STRIPPING WATER BLOCKING MATERIAL

(75) Inventor: Harry Van Der Meer, Uxbridge, MA (US)

(73) Assignee: General Cable Technologies Corporation, Highland Heights, KY (US)

( * ) Notice: Subject to any disclaimer, the term of this patent is extended or adjusted under 35 U.S.C. 154(b) by 227 days.

(21) Appl. No.: 12/828,899

(22) Filed: Jul. 1, 2010

(65) Prior Publication Data

US 2012/0000690 A1 Jan. 5, 2012

(51) Int. Cl.
*H01B 7/00* (2006.01)

(52) U.S. Cl.
USPC ..... 174/113 R

(58) Field of Classification Search ..... 174/113 R, 174/116, 105 R
See application file for complete search history.

(56) References Cited

U.S. PATENT DOCUMENTS 3,894,172 A 7/1975 Jachimowicz et al.
5,138,685 A * 8/1992 Arroyo et al. ..... 385/113
5,756,159 A 5/1998 Hoskins et al.
5,949,018 A * 9/1999 Esker ..... 174/23 R
6,010,788 A 1/2000 Kebabjian et al.
6,852,412 B2 2/2005 Keogh
7,507,909 B2 * 3/2009 Federighi et al. ..... 174/113 R
7,750,243 B1 * 7/2010 Mumm et al. ..... 174/110 R
2004/0050578 A1 3/2004 Hudson
2006/0096777 A1 5/2006 Glew

FOREIGN PATENT DOCUMENTS

WO WO 2008/116008 * 9/2008

* cited by examiner

*Primary Examiner* — Chau Nguyen
(74) *Attorney, Agent, or Firm* — Blank Rome LLP

(57) ABSTRACT

A data cable with free stripping water blocking material includes a first conductor substantially surrounded by a first foam, a second conductor longitudinally adjacent the first conductor and substantially surrounded by a second foam, a solid coat substantially surrounding the first foam of the first conductor, a filler material, a shielding member, a water swellable tape, and a jacket. The first conductor with the first foam and the solid coat and the second conductor with the second foam are substantially placed within the filler material. The shielding member is placed substantially around the filler material. The water swellable tape is placed substantially around the shielding member. The jacket is placed substantially around the water swellable tape.

25 Claims, 4 Drawing Sheets

DATA CABLE WITH FREE STRIPPING WATER BLOCKING MATERIAL

CROSS REFERENCE TO RELATED APPLICATIONS

This application relates to International Application No. PCT/US2008/57531, now expired and published as WO 2008/116008 on Sep. 25, 2008, which claims priority to U.S. Provisional Patent Application No. 60/895,584, filed Mar. 19, 2007, the disclosures of which are incorporated herein by reference in its entirety.

FIELD OF THE INVENTION

The present invention relates to a data cable. In particular, the present invention relates to a data cable containing a free stripping water blocking material.

BACKGROUND OF THE INVENTION

Several different types of data cables are in use today. Some data cables utilize optical fibers to transmit light signals, while others use conductors to convey electrical data signals. To minimize potential incompatibility between data cables of the same general type, standards have been established. For conductive data cables, one such standard is known as TIA/EIA-568-B for eight-conductor, 100-ohm, balanced, twisted-pair cabling, such as category 5e conductive data cables. The most identifiable feature of category 5e data cables are their pin/pair assignments. The pin/pair assignment of category 5e cables is often referred to as "eight position eight conductors," ("8P8C") or sometimes referred to as "RJ45." Category 5e conductive data cables are often used in commercial settings where a spectrum of at least 100 MHz is required for data transmission. Typical applications include 10 base T, 100 base TX, token ring, 1000 base T gigabit Ethernet, 155 Mbps ATM, or 622 Mbps ATM.

Depending on the location, to effectively convey data signals from one location to another, a conductive data cable must minimize or prevent moisture inside the data cable since high moisture levels can degrade conductivity and result in loss of data or data distortion. Depending on the construction of the particular data cable, the introduction of moisture can result in a short circuit, a decrease in the data cable's impedance, an increase in signal attenuation, or in the complete failure of the data cable.

Moisture can penetrate to the interior of the data cable in several different ways. Water may enter through a failure in a data cable's jacket. Water may also enter through a cable end, where a cable connector is attached. Mechanical impacts, electrical arcs, or lightning may breach the jacket that protects the data cable or the joint where one data cable joins another. Water may then flow through the breach towards the core of the data cable and longitudinally along the length of the data cable. Also, changes in ambient conditions may lead to differences in water vapor pressure between the interior and the exterior of the data cable. The difference in vapor pressure may then cause moisture to diffuse into the interior of the data cable. Eventually, there may be an undesirable level of moisture inside the cable.

Since the data cable's ability to resist penetration by moisture may be a crucial characteristic in certain applications, the data cable must be tested and meet certain performance specifications to ensure that the presence of water will not significantly affect the data cable. Several different performance specifications pertain to waterproof data cables. The particular specification used depends on the proposed application and use. One such specification is MIL-DTL-24643/59, which is set by Naval Sea Systems Command. It prescribes the water blocking requirements for a conductive data cable to be used on a Navy ship. To meet the requirements of MIL-DTL-24643/59, an open end of the data cable is subjected to a predetermined water pressure for a predetermined amount of time. Data cables that allow limited water migration to a specified length when subjected to the test are deemed "waterproof."

Various methods have been used to block water. One method of protecting data cables against water penetration is to provide a layer of plastic or polymeric material. In a cable insulated by a polymeric material, water can travel by capillary action along the cable interstices, causing problems in conductivity. In most environments, it is desirable, if not essential, that the cable be more watertight than can be achieved with polymeric material alone. Some data cables may include a metal/plastic laminate foil beneath the outer protective jacket of the data cable. The metal/plastic laminate foil may become bonded to the polymeric material, normally when the polymer is extruded. However, it is difficult to design a jacket in which the laminate foil remains intact when the data cable is subjected to impact or bending during or after installation as the laminate tends to be driven into gaps between conductors lying underneath the laminate and cracks quickly along the resulting crease lines.

Another method of protecting a data cable against water penetration is to use water swellable materials. However, when water swellable materials are exposed to high humidity over a period of time, they expand by as much as three times their original volume. Associated dielectric properties of water swellable materials, such as dissipation factor and dielectric constant, change as water swellable materials absorb moisture. The water swellable materials are generally in close proximity to the insulated conductors of the data cable. Thus, changes in the dielectric properties of the water swellable materials affect the dielectric properties of conductive data cables, and changes in the dielectric properties of conductive data cables affect their data transmission capabilities. Therefore, when the dielectric properties of the water swellable materials change, the change affects the data transmission capabilities of conductive data cables.

Filler materials are also commonly used in conductive data cables to prevent water penetration by capillary action along cable interstices. Filler materials are commonly synthetic polymers, petroleum based greases, oils, or silicone flooding compounds. Filler materials may be coated on components of the conductive data cable to prevent longitudinal movement of moisture. In addition, the interstices within the cable may be filled with the filler material to minimize water entry and migration. However, applying filler material in order to block water necessitates additional handling and processing steps in the manufacturing of the cable. The additional steps increase manufacturing time. Further, the addition of filler material significantly increases the weight of the electrical cable. Finally, moisture blocking filler material is typically difficult to remove during termination which significantly increases termination time.

Thus, there is a need in the art for an invention to provide better protection of data cables against water penetration. Particular need remains for water blocking protection that does not change the transmission properties of the data cable. Also, the water blocking protection must be easily removed from the conductors during termination. Furthermore, the water blocking protection must allow the cable to meet the requirements of MIL-DTL-24643/59. Lastly, the water blocking protection must not cause failure of the propagation delay and delay skew for cables with multiple pairs of conductors.

SUMMARY OF THE INVENTION

Accordingly, it is an object of the present invention to provide protection against water penetration of a data cable that is capable of both blocking water and maintaining transmission properties of the data cable. Another object is to provide water blocking protection that allows the data cable to be easily terminated without delays caused by difficult to remove water blocking materials from the cable. Yet another object is to provide a data cable that meets the requirements of the specification MIL-DTL-24643/59. Yet another object is to fully meet the propagation delay and delay skew requirements of MIL-DTL-24643/59. An exemplary embodiment of the present invention provides a data cable. The data cable includes a first conductor substantially surrounded by a first foam, a second conductor longitudinally adjacent the first conductor and substantially surrounded by a second foam, a solid coat substantially surrounding the first foam of the first conductor, a filler material, a shielding member, a water swellable tape, and a jacket. The first conductor with the first foam and the solid coat and the second conductor with the second foam are substantially placed within the filler material. The shielding member is placed substantially around the filler material. The water swellable tape is placed substantially around the shielding member. The jacket is placed substantially around the water swellable tape.

Another embodiment of the present invention provides a data cable. The data cable includes a first pair of conductors, a second pair of conductors, a solid coat, a filler material, a shielding member, a water swellable tape, and a jacket. Each of the conductors of the first pair of conductors is intertwined with each other with a first lay length, and each of the conductors of the first pair is substantially surrounded by a first foam. The second pair of conductors is longitudinally adjacent the first pair of conductors. Each of the conductors of the second pair of conductors is intertwined with each other with a second lay length that is different than the first lay length, and each of the conductors of the second pair is substantially surrounded by a second foam. The solid coat substantially surrounds the first foam of the conductors of the first pair. The first pair of conductors with the first foam and the solid coat and the second pair of conductors with the second foam are substantially placed within the filler material. The shielding member is placed substantially around the filler material. The water swellable tape is placed substantially around the shielding member. The jacket is placed substantially around the water swellable tape.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE INVENTION

Referring to FIGS. 1-4, the present invention relates to a data cable 100 that substantially prevents penetration of water. The data cable 100 has water blocking protection that includes water swellable materials, but the water swellable materials are isolated and separated from the conductors 102 of the data cable 100. By isolating and separating the water swellable materials from the conductors 102, expansion of the water swellable materials does not substantially affect the transmission properties of the data cable 100. Also, the type of waterblocking material utilized in the construction of the data cable 100 allows for simpler termination by easy removal or peeling away of any water blocking protection. Furthermore, the data cable 100 substantially meets or exceeds the requirements of MIL-DTL-24643/59, which specifies the requirements for water blocking data cable used aboard Navy ships.

Figure 1:
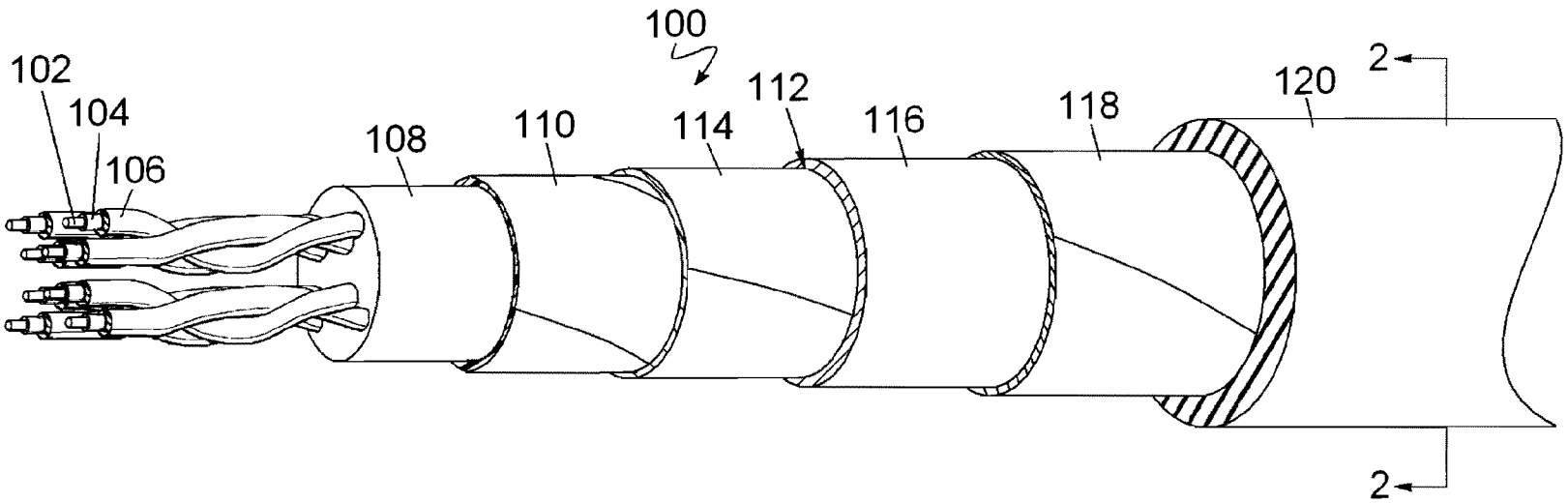
FIG. 1 is a partial perspective view of a data cable according to an exemplary embodiment of the present invention, various layers of the cable being exposed for the purposes of illustration.

Referring to FIG. 1, a partial perspective view of the data cable 100 according to an embodiment of the invention is shown. The data cable 100 includes one or more conductors 102, a foam 104 substantially around each of the conductors 102, and a solid coat 106 substantially around the foam 104. In the embodiment of FIG. 1, the conductors 102 substantially surrounded by the foam 104 and the solid coat 106 are placed within a filler material 108. The filler material 108 is substantially wrapped with a corewrap 110 which is itself substantially surrounded by a shielding member 112. The shielding member 112 is substantially wrapped with a water swellable tape 118, and finally, a jacket 120 substantially covers an outermost surface of the data cable 100.

The conductors 102 provide pathways for data signals. In the embodiment shown, eight conductors 102 are intertwined so as to form four twisted pairs of conductors 102. The conductors 102 are made of copper and are 24 American Wire Gauge ("AWG") per ASTM B8 Class B. The twisting lay is between approximately one-half inch to approximately one inch. Each pair of conductors 102 are twisted with a different lay length. In other embodiments, the conductors 102 may be made of another material, be of another gauge or AWG, or have a different twisting lay. The number, material, gauge, and the twisting lay of the conductors 102 is not meant to be limiting but meant to illustrate one particular embodiment to describe the data cable 100. For example, the conductors 102 can be made of other electrically conductive materials such as, but not limited to, aluminum, silver, gold, or some other electrically conductive metal or alloy or combination of the aforementioned materials. The conductors 102 can also be plated with another electrically conductive material, such as tin, silver, nickel, or other suitable plating material. Furthermore, although each of the conductors 102 may be a solid conductor, each of the conductors 102 may alternatively be made up of several conductive strands.

Figure 2:
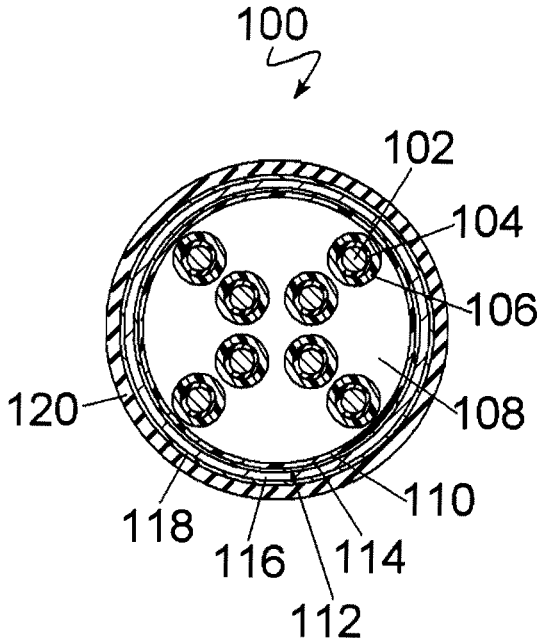
FIG. 2 is a sectional view taken substantially along line 2-2 of the data cable illustrated in FIG. 1.

Referring to FIG. 2, the conductors 102 are arranged longitudinally adjacent to one another to provide the cable 100 with a substantially circular cross-section. Also, in the embodiment depicted, although two adjacent conductors 102 are intertwined with each other to form a twisted pair, the conductors 102 may be intertwined in the same direction, or the conductors 102 may be intertwined in a direction different from the intertwining of other conductors 102. Furthermore, the conductors 102 may be intertwined to form a helical braid or a helical spiral.

The conductors 102 shown are substantially covered with a foam 104. The foam 104 provides electrical insulation and water blocking. Bubbles in the foam 104 and the foam 104 itself provide electrical insulation. Also, the foam 104 should have good dielectric properties and should be extrudable. In the embodiment shown, the foam 104 is made from high density polyethylene (HDPE) which provides electrical insulation, has good dielectric properties, and is extrudable. In the depicted embodiment, the foam 104 is approximately 6-7 mils thick. The thickness of the foam 104 is exemplary only, and is not intended to be limiting to the invention; the optimal thickness of the foam 104 may be less than 6 mils or more than 7 mils.

The solid coat 106 substantially surrounds the foam 104 and provides mechanical support for the foam 104. The solid coat 106 can be made of any material that provides rigid support. In the embodiment shown, the solid coat 106 is made of HDPE and is about 5 mils thick. The thickness of the solid coat 106 is exemplary only to describe one embodiment of the invention.

A layer of insulation (not shown) may be placed around the foam 104, in which case the solid coat 106 would then be placed over the insulation. The insulation may be made of an appropriate dielectric material. Also, the insulation may be colored, coded, marked, or otherwise processed to provide identification. In one embodiment, the insulation is made of HDPE.

The conductors 102 substantially surrounded by the foam 104 and the solid coat 106 are disposed within the filler material 108. The filler material 108 blocks water. To meet the requirements of MIL-DTL-24643/59, the filler material 108 is preferably a free stripping material or made of a material with a substantially solid consistency. In the embodiment shown, the filler material 108 is made from commercially available "UNIBLOC™," which is manufactured by Unigel. The filler material 108 can include a super absorbent polymer (SAP). The filler material 108 can also be a polymer impregnated with SAP.

The filler material 108 may be substantially surrounded with the corewrap 110. The corewrap 110 provides support to the filler material 108 while the conductors 102 are disposed within the filler material 108. In the depicted embodiment, the corewrap 110 is made of mylar which is helically wrapped with about 25% or greater overlap.

The shielding member 112 substantially surrounds the corewrap 110. The shielding member 112 provides electrical shielding. In the embodiment shown, the shielding member 112 includes an aluminum/mylar tape 114 helically applied and a copper braid 116. The aluminum/mylar tape 114 is a tape with aluminum on one side and mylar on the other with a coat of water swellable material on at least one side. The depicted embodiment has the aluminum side facing outward and water swellable material on the mylar side. Also, the aluminum/mylar tape 114 has about 25% overlap or greater. The copper braid 116 is made from 36 AWG copper wires with approximately 65% coverage.

The water swellable tape 118 is placed around the shielding member 112. The water swellable tape 118 is made of any soft, fibrous, gauze-like material that can absorb moisture or that contains water swellable material. The water swellable tape 118 can be made of a super absorbent polymer tape impregnated with a powder-like water swellable material. The water swellable tape 118 can also be made of super absorbent powder laminated between non-woven materials. In the embodiment shown, the water swellable tape 118 is one manufactured by Scapa.

Because the shielding member 112 is disposed between the conductors 102 and the water swellable tape 118, if the water swellable tape 118 expands, the water swellable tape 118 does not affect either the electrical or the transmission properties of the data cable 100. Thus, the embodiment shown provides water blocking protection and maintains the transmission properties of the data cable 100.

The jacket 120 wraps the outermost peripheral area of the cable 100. In the embodiment shown, the jacket 120 is made of a fire retardant, substantially halogen free polyolefin with cross link agents. With the described construction, the jacket 120 meets the standards delineated in MIL-DTL-24643/59. The jacket 120 emits little smoke, minor amounts of toxic fumes when the jacket 120 is combusted, and contains substantially no halogens.

The embodiment of the data cable 100, as described above, substantially meets or exceeds the standards of MIL-DTL-24643/59. Also, with the above described construction, the data cable 100 has a weight per length of approximately 28.6 kg per 304.8 meters or 63 pounds per 1,000 feet nominally. The data cable 100 also has the following electrical characteristics.

| | Attenuation (dB/100 m) | | NEXT (dB) | | PSNEXT (dB) | | ACR (dB/100 m) | |
|---|---|---|---|---|---|---|---|---|
| Frequency (MHz) | Typ-ical | Max-imum | Typ-ical | Min-imum | Typ-ical | Min-imum | Typ-ical | Min-imum |
| 0.772 | 1.5 | 1.8 | 86.3 | 67.0 | 79.9 | 64.0 | 84.8 | 65.2 |
| 1 | 1.7 | 2.0 | 82.3 | 65.3 | 76.0 | 62.3 | 80.6 | 63.3 |
| 4 | 3.5 | 4.1 | 76.5 | 56.3 | 70.1 | 53.3 | 72.9 | 52.2 |
| 8 | 5.0 | 5.8 | 70.9 | 51.8 | 61.4 | 48.8 | 65.9 | 46.0 |
| 10 | 5.7 | 6.5 | 65.7 | 50.3 | 59.7 | 47.3 | 60.1 | 43.8 |
| 16 | 7.2 | 8.2 | 64.6 | 47.3 | 58.1 | 44.3 | 57.4 | 39.1 |
| 20 | 8.2 | 9.3 | 63.0 | 45.8 | 57.0 | 42.8 | 54.8 | 36.5 |
| 25 | 9.1 | 10.4 | 62.3 | 44.3 | 55.2 | 41.3 | 53.1 | 33.9 |
| 31.25 | 10.3 | 11.7 | 59.0 | 42.9 | 50.2 | 39.9 | 48.7 | 31.2 |
| 62.5 | 14.9 | 17.0 | 56.1 | 38.4 | 49.6 | 35.4 | 41.2 | 21.4 |
| 100 | 19.3 | 22.0 | 49.0 | 35.3 | 41.8 | 32.3 | 29.7 | 13.3 |

| | PSACR (dB/100 m) | | ELFEXT (dB/100 m) | | PSELFEXT (dB/100 m) | | RL (dB) |
|---|---|---|---|---|---|---|---|
| Frequency (MHz) | Typ-ical | Max-imum | Typ-ical | Min-imum | Typ-ical | Min-imum | Min-imum |
| 0.772 | 78.4 | 62.2 | 87.1 | 66.0 | 83.6 | 63.0 | — |
| 1 | 74.3 | 60.3 | 80.9 | 63.8 | 78.7 | 60.8 | 20.0 |
| 4 | 66.5 | 49.2 | 72.3 | 51.7 | 68.8 | 48.7 | 23.0 |
| 8 | 56.3 | 43.0 | 64.4 | 45.7 | 63.5 | 42.7 | 24.5 |
| 10 | 54.0 | 40.8 | 62.5 | 43.8 | 61.8 | 40.8 | 25.0 |
| 16 | 50.9 | 36.1 | 61.2 | 39.7 | 57.5 | 36.7 | 25.0 |
| 20 | 48.8 | 33.5 | 61.2 | 37.7 | 54.6 | 34.7 | 25.0 |
| 25 | 46.0 | 30.9 | 60.0 | 35.8 | 54.6 | 32.8 | 24.3 |
| 31.25 | 39.8 | 28.2 | 55.5 | 33.9 | 51.6 | 30.9 | 23.6 |
| 62.5 | 34.6 | 18.4 | 47.5 | 27.8 | 44.2 | 24.8 | 21.5 |
| 100 | 22.5 | 10.3 | 35.6 | 23.8 | 38.8 | 20.8 | 20.1 |

| | |
|---|---|
| DC Resistance: | 9.38 Ω/100 m (28.6 Ω/Mft) Maximum |
| DCR Unbalanced: | 5% Maximum |
| Mutual Capacitance: | 55.8 pF/m (17 pF/ft) Maximum |
| Capacitance Unbalanced: | 330 pF/100 m (1 pF/ft) Maximum |
| Characteristic Impedance: | 100 Ω ± 15% (1-100 MHz) |
| Input Impedance: | 100 Ω ± 15% (1-100 MHz) |
| Prop. Delay (Skew): | 45 ns/100 m Maximum |
| Velocity of Propagation: | 69% Nominal |

-continued

| | |
|---|---|
| Temperature Rating: | −20° C. to +75° C. |
| Voltage Rating: | 300 V Maximum |

A method of manufacturing the data cable 100 begins with providing conductors 102. The conductors 102 are pulled through a foam and solid insulation extruder. The foam and solid insulation extruder places foam insulation 104 around each conductor 102 and the solid insulation 106 around the foam insulation 104. The insulation may be colored, coded, marked, or otherwise processed to provide identification. In one embodiment, pairs of the conductors 102 are twisted together where the twisting lay is between approximately one-half inch to approximately one inch. Next, the conductors 102 which are substantially surrounded by the foam 104 and the solid coat 106 are placed in the filler material 108. Corewrap 110 made of mylar contains the filler material 108 while the conductors 102 are placed in the filler material 108. Then, the shielding member 112 is placed around the corewrap 110. In one embodiment, the aluminum/mylar tape 114 is pulled around the filler compound 108 and then a tin plated copper braid 116 is weaved around the aluminum/mylar tape 114. Water swellable tape 118 may be wrapped around the shielding member 112. Finally, the jacket 120 is placed around the shielding member 112. In one embodiment, the jacket 120 is extruded around the shielding member 112. If the jacket 120 is made of a material containing cross link agents, then the data cable 100 undergoes cross linking. The cross linking can be completed by electron beam exposure.

Figure 3:
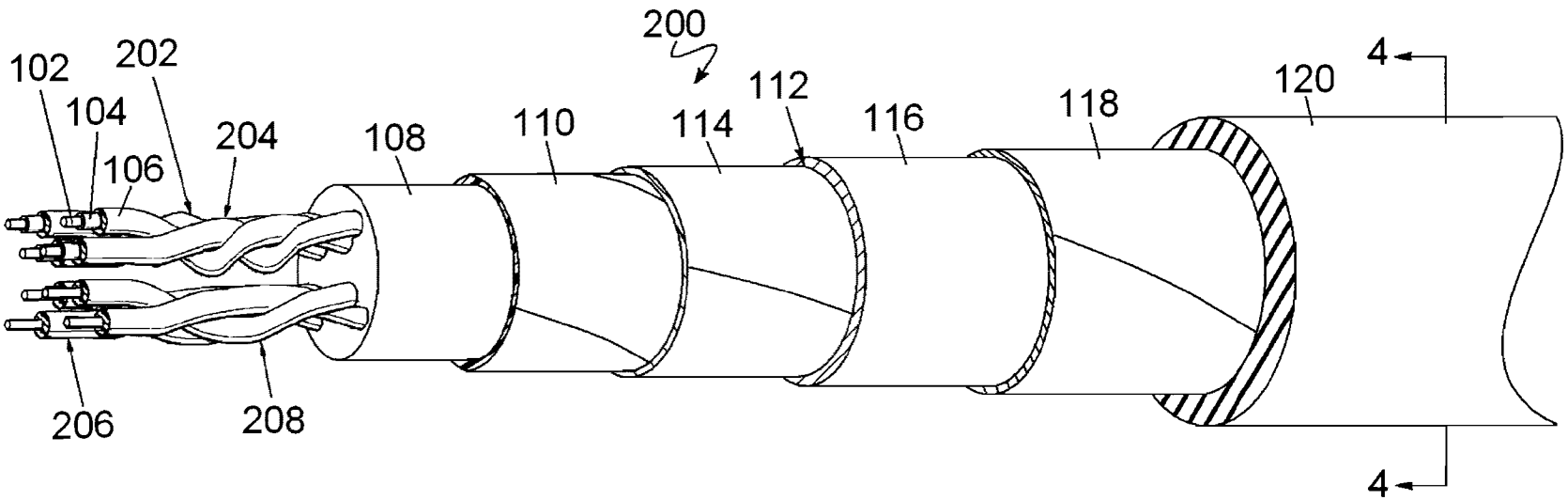
FIG. 3 is a partial perspective view of a data cable according to another embodiment of the present invention, various layers of the cable being exposed for the purposes of illustration.
Figure 4:
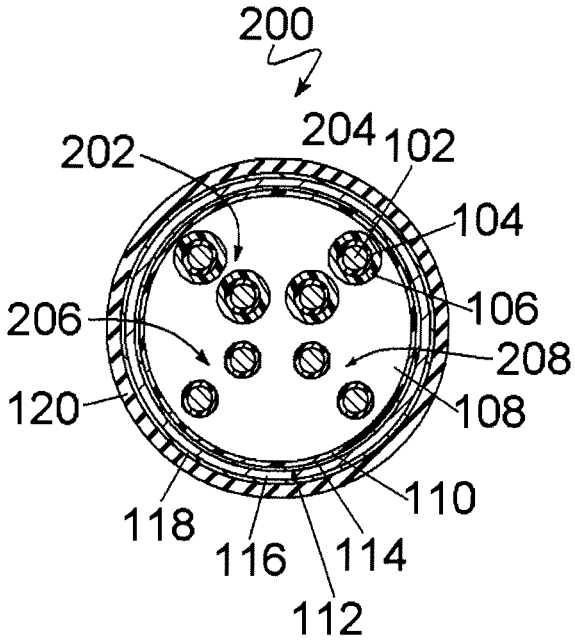
FIG. 4 is a sectional view taken substantially along line 4-4 of the data cable illustrated in FIG. 3.

Referring to FIGS. 3-4, another embodiment of the present invention is shown. The embodiment in FIGS. 3-4 has at least one conductor 102 with foam 104 and a solid coat 106 and at least one conductor 102 with only a solid coat 106. Thus, unlike the embodiment depicted in FIGS. 1-2, the embodiment of FIG. 3 has at least one conductor 102 with only a solid coat 106 and no foam 104.

The alternate embodiment of the invention addresses the phenomena of propagation delay and delay skew. Propagation delay is the amount of time that elapses between when a signal is transmitted at one end of the cable 200 and when a signal is received on the other end of the cable 200. The actual amount of time that passes for twisted-pair cables is a function of a nominal velocity of propagation, length of the cable, and frequency of the signal.

The nominal velocity of propagation varies according to the dielectric materials used in the cable and is typically expressed as a percentage of the speed of light (c). Category 5e cables made with polyethylene have nominal velocities of propagation ranging between 0.65 c to 0.70 c or between 65% of the speed of light to 70% of the speed of light, where the speed of light is approximately $3\times10^8$ meters per second. As nominal velocity of propagation decreases, propagation delay increases for a given length of cable because, when the signal travels slower, it takes more time to travel from one point to another in the cable, and the delay increases. In addition to the nominal velocity of propagation, propagation delay is also a function of the length of the cable. For a given nominal velocity of propagation, as the length of the cable increases, the signal takes more time to travel to cover the additional distance, and thus, propagation delay increases. Lastly, propagation delay is a function of frequency.

Because propagation delay is a function of nominal velocity of propagation, length of the cable, length of twist lay, and frequency of the signal, multiple pairs of conductors placed within the same cable can have different propagation delays. When multiple pairs of conductors in the same cable exhibit different propagation delays, the difference in propagation delays between pairs of conductors is known as delay skew. All twisted pair cables have delay skew to some extent. Delay skew is determined by measuring the propagation delay difference between the pair with the smallest delay and the pair with the greatest delay. Because propagation delay is a function of nominal velocity of propagation which varies with dielectric materials used in the cable, material selection and physical design of the cable affect delay skew. For example, poor dielectric construction or extreme differences in lay length between pairs give rise to greater delay skew. Increased propagation delay and greater delay skew cause transmission problems, such as increased jitter and bit error rates.

To address propagation delay and delay skew, in the embodiment depicted in FIG. 3, the data cable 200 has two pairs 202 and 204 of conductors 102, where each conductor 102 is surrounded by foam 104 and a solid coat 106, and another two pairs 206 and 208 of conductors 102, where each conductor is substantially surrounded by a solid coat 106 only. Also, the conductors 102 with foam 104 and solid coats 106 have a shorter lay length than the conductors 102 with solid coats 106 only. In one embodiment, conductive pair 202 has a lay length of 0.3880±0.0050 inches and conductive pair 204 has a lay length of 0.4190±0.0050 inches, while conductive pair 206 has a lay length of 0.6170±0.0020 inches and conductive pair 208 has a lay length of 0.7800±0.0020 inches. Providing some conductors 102 with foam 104 and a solid coat 106 and a relatively shorter lay length reduces the effective dielectric constant of the insulation and increases the nominal velocity of propagation, thus effectively reducing the difference between the propagation delay between pairs 206 and 208 of conductors 102 with relatively longer lay lengths and pairs 202 and 204 of conductors 102 with relatively shorter lay lengths. Therefore, the foam 104 and shorter lay lengths improves delay skew between pairs 202, 204, 206, and 208 of conductors 102.

The filler material 108, the corewrap 110, the shielding member 112, the water swellable tape 118, and the jacket 120 are substantially the same as in the embodiment shown in FIGS. 1-2, thus a detailed description of those components is omitted.

As is apparent from the above description, the present invention provides a data cable 100 and 200 that is capable of blocking water while substantially maintaining transmission properties. The data cable 100 and 200 has water blocking protection that includes water swellable materials whose dielectric properties change as the water swellable material expands. However, the water swellable materials are separated from the conductors 102 by, at least, the shielding member 112, which prevents the water swellable material from affecting the transmission properties of the conductors 102. Furthermore, the data cable 100 and 200 substantially meets or exceeds the requirements of MIL-DTL-24643/59, which specifies the requirements for water blocking data cable used aboard Navy ships. Lastly, the data cable 200 according to another embodiment mitigates problems arising from propagation delay and delay skew.

While a particular embodiment has been chosen to illustrate the invention, it will be understood by those skilled in the art that various changes and modifications can be made therein without departing from the scope of the invention as defined in the appended claims.

For instance, while the conductors 102 are placed longitudinally to provide the data cable 100 with a substantially circular cross-section, each of the conductors 102 may also be placed longitudinally adjacent to each other to form a substantially triangular, rectangular, trapezoidal, or polygonal cross-section.

Also, although the embodiment described has HDPE as the insulation covering the conductors 102, the dielectric material covering the conductors 102 may also be, but not limited to, thermoset, thermoset polyethylene, thermoplastic, thermoplastic fluoropolymer, fluorocarbon-based polymer, polyethylene, polyvinyl chlorides (PVC), polyvinylidene fluoride (PVDF), ethylene tetrafluoroethylene (ETFE), ethylene propylene rubber (EPR), silicone, silicone tape, rubber tape, glass tape, combinations of the aforementioned materials, or other electrically insulating material.

Furthermore, other than HDPE, the foam 104 can also be made of polypropylene, LDPE, LLDPE, MDPE, thermoplastic polymer, PVC, fluoropolymer, polytetrafluoroethylene (PTFE), fluorinated ethylene-propylene (FEP), perfluoroalkoxy polymer resin (PFA), combinations of the above materials, or other similar materials. Fluoropolymers include fully fluorinated fluorocarbon polymers and partially fluorinated polymers such as polychlorotrifluoroethylene (PCTFE), ETFE, ethylene chlorotrifluoroethylene (ECTFE), and PVDF.

As for the solid coat 106 surrounding the foam 104, the solid coat 106 can be made of polypropylene, LDPE, LLDPE, MDPE, thermoplastic polymer, PVC, PTFE, FEP, PFA, combinations of the aforementioned materials, or other similar materials, instead of HDPE. In an alternative embodiment, the solid coat 106 can be disposed substantially on each of the conductors 102 without the foam 104 so that the solid coat 106 provides both insulation and mechanical support.

Additionally, the shielding member 112 may be aluminum, aluminum foil, aluminum braid, combinations of the aforementioned materials, or any other electrically shielding material. And, the jacket 120 may be made of a non-conductive material, such as, but not limited to, a polymer or a plastic.

What is claimed is:

1. A data cable comprising:

a first conductor substantially surrounded by a foam;

a second conductor longitudinally adjacent the first conductor;

a first solid coat substantially surrounding the foam of the first conductor;

a second solid coat substantially surrounding the second conductor such that nothing is between the second solid coat and the second conductor;

a filler material within which the first conductor with the foam and the first solid coat and the second conductor with the second solid coat are substantially disposed;

a corewrap disposed substantially around the filler material;

a shielding member disposed substantially around the corewrap, the shielding member including a water swellable coating;

a water swellable tape disposed substantially around the shielding member; and a jacket disposed substantially around the water swellable tape.

2. The data cable according to claim 1, wherein the first conductor comprises a plurality of conductive strands.

3. The data cable according to claim 1, wherein the second conductor comprises a plurality of conductive strands.

4. The data cable according to claim 1, wherein the first conductor is a pair of conductors intertwined with each other.

5. The data cable according to claim 1, wherein the second conductor is a pair of conductors intertwined with each other.

6. The data cable according to claim 1, wherein the first conductor is a pair of conductors intertwined with each other with a first lay length; and wherein the second conductor is a pair of conductors intertwined with each other with a second lay length that is longer than the first lay length.

7. The data cable according to claim 1, wherein the foam is made of high density polyethylene (HDPE).

8. The data cable according to claim 1, wherein each of the first and second solid coat is made of high density polyethylene (HDPE).

9. The data cable according to claim 1, wherein the filler material is substantially free stripping.

10. The data cable according to claim 1, wherein the corewrap is made of mylar.

11. The data cable according to claim 1, wherein the shielding member comprises a tape made of aluminum and mylar.

12. The data cable according to claim 1, wherein the shielding member comprises a conductive braid.

13. The data cable according to claim 12, wherein the braid comprises a plurality of copper wires.

14. The data cable according to claim 1, wherein the jacket is made of a fire retardant, substantially halogen free polyolefin with cross link agents.

15. A data cable comprising:

a first pair of conductors, each of the conductors of the first pair intertwined with each other with a first lay length, each of the conductors substantially surrounded by a first foam;

a second pair of conductors longitudinally adjacent the first pair of conductors, each of the conductors of the second pair intertwined with each other with a second lay length that is different than the first lay length;

a first solid coat substantially surrounding the first foam of each of the conductors of the first pair;

a second solid coat substantially surrounding each of the conductors of the second pair such that nothing is between the second solid coat and each of the conductors of the second pair;

a filler material within which the first pair of conductors with the first foam and the first solid coat and the second pair of conductors with the second solid coat are substantially disposed;

a corewrap disposed substantially around the filler material;

a shielding member disposed substantially around the corewrap, the shielding member including a water swellable coating;

a water swellable tape disposed substantially around the shielding member; and a jacket disposed substantially around the water swellable tape.

16. The data cable according to claim 15, wherein each of the conductors of the first pair comprises a plurality of conductive strands.

17. The data cable according to claim 15, wherein each of the conductors of the second pair comprises a plurality of conductive strands.

18. The data cable according to claim 15, wherein the first foam is made of high density polyethylene (HDPE).

19. The data cable according to claim 15, wherein each of the first and second solid coat is made of high density polyethylene (HDPE).

20. The data cable according to claim 15, wherein the filler material is substantially free stripping.

21. The data cable according to claim 15, wherein the corewrap is made of mylar.

22. The data cable according to claim 15, wherein the shielding member comprises a tape made of aluminum and mylar.

23. The data cable according to claim 15, wherein the shielding member comprises a conductive braid.

24. The data cable according to claim 23, wherein the braid comprises a plurality of copper wires.

25. The data cable according to claim 15, wherein the jacket is made of a fire retardant, substantially halogen free polyolefin with cross link agents.

* * * * *